United States Patent [19]

Ranz et al.

[11] 4,173,479

[45] Nov. 6, 1979

[54] COLOR PHOTOGRAPHIC RECORDING MATERIAL

[75] Inventors: Erwin Ranz, Leverkusen; Joachim W. Lohmann, Kuerten; Heinz-Dieter Schütz, Bergisch-Gladbach, all of Fed. Rep. of Germany

[73] Assignee: AGFA-Gevaert, A.G., Leverkusen-Bayerwerk, Fed. Rep. of Germany

[21] Appl. No.: 873,739

[22] Filed: Jan. 31, 1978

[30] Foreign Application Priority Data

Feb. 5, 1977 [DE] Fed. Rep. of Germany ..... 2704797

[51] Int. Cl.[2] ..... G03C 1/76

[52] U.S. Cl. ..... 430/507; 430/559

[58] Field of Search ..... 96/74, 77, 100, 95

[56] References Cited

U.S. PATENT DOCUMENTS

| | | | |
|---|---|---|---|
| 3,632,345 | 1/1972 | Marx et al. | 96/100 |
| 3,642,485 | 2/1972 | Oishi et al. | 96/74 |
| 3,737,317 | 6/1973 | Nicholas et al. | 96/74 |
| 3,790,384 | 2/1974 | Oishi et al. | 96/74 |
| 3,932,185 | 1/1976 | Matsuura | 96/74 |
| 3,990,899 | 11/1976 | Shiba et al. | 96/74 |
| 4,015,988 | 4/1977 | Shiba et al. | 96/74 |
| 4,055,429 | 10/1977 | Holmes et al. | 96/74 |

FOREIGN PATENT DOCUMENTS

| | | | |
|---|---|---|---|
| 2530645 | 1/1976 | Fed. Rep. of Germany | 96/74 |

*Primary Examiner*—Won H. Louie, Jr.

[57] ABSTRACT

Improved sensitivity and improved interimage effects are obtained in a multilayer color-photographic recording material having two red-sensitive, two green-sensitive and a blue-sensitive silver halide emulsion layer as well as a yellow filter layer, the more sensitive red-sensitive and the more sensitive green-sensitive layers forming a comparatively more sensitive layer unit arranged further away from the support than each of the less sensitive green-sensitive and the less sensitive red-sensitive layer but nearer to the support than the yellow filter layer underneath the blue-sensitive layer; an additional chloride-containing silver halide emulsion layer of comparatively low sensitivity containing a non-diffusible DIR compound of low reactivity is arranged within the comparatively more sensitive layer unit between the red-sensitive and the green-sensitive layers.

3 Claims, 2 Drawing Figures

COLOR PHOTOGRAPHIC RECORDING MATERIAL

This invention relates to a colour photographic recording material comprising several silver halide emulsion layers, of which at least two contribute towards producing the cyan component colour image whilst at least another two contribute towards producing the magenta component colour image, and in which an improved sensitivity, particularly of the cyan and magenta component colour image, and an improved colour reproduction are obtained by a special layer arrangement.

It is known that coloured photographic images can be produced by using recording materials which, on a layer substrate, carry a red-sensitive, a green-sensitive and a blue-sensitive silver halide emulsion layer, each of the silver halide emulsion layers containing non-diffusible colour couplers for producing the cyan, the magenta and the yellow component colour images and the colour of each of the component colour images produced being complementary to the spectral sensitivity of the silver halide emulsion layer. Conventional colour photographic materials also contain further layers such as, for example, a yellow filter layer between the uppermost blue-sensitive silver halide emulsion layer and the underlying green-sensitive silver halide emulsion layer, and also an antihalation layer between the support and the lowermost silver halide emulsion layer. Additional gelatin intermediate layers and a cover layer may also be provided.

It is also known that colour photographic images can be produced by using recording materials of the type in which at least two silver halide emulsion layers are respectively provided for producing one or more of the three different component colour images. Thus, according to British Pat. No. 818,687, the lowermost photosensitive colour-forming layer unit of a colour photographic multilayer material consists of two component layers which contain silver halide and colour couplers, are sensitised to light of the same spectral region and of which the upper component layer has the greater sensitivity. German Pat. No. 1,121,470 describes the use of double layers of different sensitivity of which the more sensitive layer produces the lower colour density during colour development. In this way, it is possible to increase sensitivity without at the same time adversely affecting graininess.

Colour photographic recording materials with double layers for the various spectral regions are also known from U.S. Pat. Nos. 3,663,228 and 3,849,138. In these cases, too, the upper of the two component layers sensitive to light of the same spectral region has the higher sensitivity. However, the layer structures described in the two above-mentioned U.S. Patents are essentially intended for increasing the exposure latitude, there being no reference to any increase in sensitivity. FIG. 1*c* of these two U.S. Patents shows a material which contains two laminates which are separated from one another by neutrally grey filter and each of which consists of a red-sensitive, a green-sensitive and a blue-sensitive silver halide emulsion layer.

In this case, therefore, the two component layers which are sensitive to light of the same spectral region, but which differ in their sensitivity, are not accommodated adjacent to one another, but instead are accomodated in different laminates of different general sensitivity, several silver halide emulsion layers of different spectral sensitivity, but of comparable general sensitivity, being combined in each laminate. Component layers of the same spectral sensitivity are separated from one another by several layers of different spectral sensitivity and by the grey filter. A similar structure, but with coloured filters, by which a greater exposure latitude is also obtained is known from U.S. Defensive Publication T 860,004.

In addition, German Offenlegungsschriften Nos. 2,453,654 and 2,453,664 describe layer structures in which, to improve sharpness, red- and/or green-sensitive component layers are arranged above the blue-sensitive silver halide emulsion layer. However, these structures give unfavourable colour reproduction with the result that materials such as these are only suitable for certain light sources, for example tungsten light.

Finally, in order to improve sensitivity, German Offenlegungsschrift No. 2,530,645 proposes a layer structure in which 1. the more sensitive of the two green-sensitive silver halide emulsion layers and the more sensitive of the two red-sensitive silver halide emulsion layers are present adjacent one another in a comparatively more sensitive emulsion layer unit;
2. the less sensitive of the two green-sensitive silver halide emulsion layers and the less sensitive of the two red-sensitive silver halide emulsion layers are present adjacent one another in a comparatively less sensitive emulsion layer unit;
3. the less sensitive emulsion layer unit lies closer to the support layer than the more sensitive emulsion layer unit;
4. in each of the two emulsion layer units, the red-sensitive emulsion layer lies closer to the layer support than the green-sensitive emulsion layer, and
5. the less sensitive green-sensitive silver halide emulsion layer is adjacent the more sensitive red-sensitive silver halide emulsion layer and is closer to the layer support than the more sensitive of the two red-sensitive silver halide emulsion layers.

It is apparent from German Offenlegungsschrift No. 2,530,645 that, on exposure, the light passes first through the blue-sensitive layer or through the blue-sensitive layers before entering the red-sensitive layers. Accordingly, the blue-sensitive layers lie above the layers which are sensitive to red or green light and above the yellow filter layer.

It is known that non-diffusible compounds which release diffusible development inhibitors in consequence of a reaction with colour developer oxidation products can be added to the photosensitive silver halide emulsion layers or even to adjacent non-photosensitive hydrophilic binder layers. Compounds such as these include the so-called DIR-couplers which are colour couplers which contain a releasable inhibitor radical in the coupling site. It is possible by using DIR-couplers such as these to improve the properties of colour photographic recording materials in several respects. For example, the use of DIR-couplers has an advantageous effect upon colour graininess and, by producing so-called inter-image effects, also upon colour reproduction. According to the description of German Offenlegungsschrift No. 2,530,645, DIR-couplers of the type which produce a magenta and/or a cyan dye may be associated both with the less sensitive and also with the more sensitive silver halide emulsion units each consisting of red-sensitive and green-sensitive component layers. However, the practical use of DIR-couplers is largely restricted to the less sensitive component layers for two reasons;

1. Where DIR-couplers are used in silver halide emulsion layers of relatively high sensitivity, a reduction in sensitivity is observed in most cases.
2. A refinement of the colour grain is particularly desirable in the less sensitive component layers having a relatively high colour coupler content and, as a result, a comparatively low ratio of silver halide to coupler; in the component layers of higher sensitivity, a relatively fine colour grain is produced in any case by a comparatively higher ratio of silver halide to coupler.

Materials such as these have a high sensitivity and fine colour graininess. In addition, although a high inter-image effect is obtained by using DIR-couplers, it is really effective only in the relatively high colour density regions of the gradation curves.

An object of the present invention is to provide a colour photographic recording material which has a high sensitivity, particularly of the cyan and the magenta component colour image, and in which colour reproduction is further improved by obtaining a high inter-image effect also in the lower colour density regions of the gradation curves of the cyan and the magenta component colour image.

The present invention provides a colour photographic recording material comprising:

(a) a layer support;

(b) differently sensitised silver halide emulsion layers containing non-diffusible colour couplers which are applied to the layer support and of which at least two are sensitive to red light and have different sensitivities and of which at least another two are sensitive to green light and have different sensitivities, the more sensitive of the two red-sensitive and the more sensitive of the two green-sensitive silver halide emulsion layers forming a comparatively more sensitive emulsion layer unit which is arranged further away from the layer support than the less sensitive of the two red-sensitive and the less sensitive of the two green-sensitive silver halide emulsion layers, and of which at least one is sensitive to blue light and is arranged further away from the support than each of the red- or green-sensitive silver halide emulsion layers, and (c) at least one yellow filter layer which is arranged further away from the support than each of the red- or green-sensitive silver halide emulsion layers and, optionally, (d) other non-photosensitive layers, in such a material the invention provides the improvement according to which an additional chloride-containing silver halide emulsion layer of comparatively low sensitivity is arranged within the comparatively more sensitive layer unit between the red-sensitive and the green-sensitive silver halide emulsion layer, said silver halide emulsion layer of comparatively low sensitivity, containing a non-diffusible compound capable of reacting with oxidation products of colour developer compounds with a release of a diffusible development inhibitor.

The additional chloride-containing silver halide emulsion layer of comparatively low sensitivity is preferably an unsensitised silver halide emulsion containing at least 20 mole % of silver chloride. Accordingly, the silver halide of the additional layer preferably consists of pure silver chloride or of silver chloride-bromide with up to 80 mole % of silver bromide, i.e. the silver chloride component of the silver halide content as a whole amounts to between 20 and 100 mole %. There is no need for sensitisation, particularly spectral sensitisation. The silver halide emulsions preferably used for the additional chloride-containing silver halide emulsion layers are, in particular, silver halide emulsions of the type in which the silver halide grains have an average grain diameter of less than 0.5 μm. Silver halide emulsions such as these include silver halide emulsions which are known under the names Mikrate emulsion or Lippman emulsion and which have an average grain diameter of less than 0.1 μm. Emulsions such as these show relatively very little photo-sensitivity. The sensitivity of the additional chloride-containing silver halide emulsions to blue light is preferably lower by 10–50 log I.t units than that of the image-recording blue-sensitive layer.

No image is intended to be recorded in the additional chloride-containing silver halide emulsion layer of comparatively low sensitivity which is present in accordance with the invention. However, a layer such as this has a favourable effect upon the sensitivity of the adjacent image-recording layers, i.e. in particular on the more sensitive red-sensitive and/or the more sensitive green-sensitive silver halide emulsion layer. This sensitivity-increasing effect is clearly greater, the smaller the grain size of the silver halide grains of the additional silver halide emulsion layer and hence their solubility and their capacity for physically developing the adjacent more sensitive silver halide emulsion layers.

The use of relatively insensitive silver halide emulsion layers in colour photographic multilayer materials is not new. However, layers such as these have hitherto primarily been used for suppressing the undesirable diffusion of sensitising dyes into adjacent layers of different spectral sensitivity (sensitiser barrier layer), for preventing the undesirable diffusion of development inhibitors into other layers (inhibitor barrier layer), or for producing a mask image in a processing step following the colour development step.

In the colour photographic materials according to the invention, the additional relatively non-photosensitive chloride-containing silver halide emulsion layers presumably act as silver halide donors during development of the adjacent silver halide layers containing highly sensitive and hence relatively course grained silver halide. Accordingly, a distinct increase in sensitivity is observed. This effect is particularly marked in the layer structure according to the invention in which, in contrast to the conventional double layer structure, the highly sensitive red- or green-sensitive silver halide emulsion layers are not arranged adjacent the corresponding less sensitive layers of the same spectral sensitivity which otherwise could also be considered as silver halide donors. The optimum quantity of silver halide applied in the additional silver halide emulsion layer of comparatively low sensitivity may readily be determined by the average expert by conducting comparative tests. It preferably corresponds to a quantity of silver nitrate of from 0.05 to 0.7 g. per square meter.

According to the invention, the intermediate layer arranged between the more sensitive red-sensitive and the more sensitive green-sensitive silver halide emulsion layer also contains a non-diffusible compound capable of reacting with colour developer oxidation products and releasing a diffusible substance which inhibits development of the silver halide. Compounds such as these are known in large numbers. They include, for example, the known DIR-couplers (DIR=development inhibitor releasing) which are colour couplers containing a releasable inhibitor radical in the coupling site. DIR-couplers such as these are described for example in U.S. Pat. No. 3,227,554. Another group of compounds which release development-inhibiting substances during reaction with colour developer oxidation products is described in U.S. Pat. No. 3,632,345. These compounds are not colour couplers. Accordingly, permanent dyes are not formed during release of the development-inhibiting substances to any substantial extent. This group of compounds are also referred to as colourlessly coupling DIR-couplers or even as DIR-compounds to distinguish them from the colour-forming DIR-couplers.

Among the known compounds which release a development inhibitor on reaction with developer oxidation products, it is preferred in accordance with the invention to use those which do not give rise to substantial formation of any permanent dyes during colour development and, hence, play no part in the structure of the colour image. The basically desirable co-coupling of the DIR-compounds which, according to the invention, are incorporated into the intermediate layer between the photosensitive layers of the comparatively more sensitive emulsion layer unit with one or both adjacent layers would result, if the DIR-couplers in question were colour-forming DIR-couplers, in the formation of undesirable secondary colour densities in the intermediate layer. Accordingly, it is less preferred in accordance with the invention to use colour-forming DIR-couplers.

By contrast, it is preferred in accordance with the invention to use colourlessly coupling DIR-couplers or so-called DIR-compounds. Compounds of this type are described not only in the above-mentioned U.S. Pat. No. 3,632,345, but also for example in German Offenlegungsschriften Nos. 2,363,752; 2,359,295; 2,405,442; 2,448,063; 2,529,350; 2,540,959 and 2,552,505.

Of these DIR-compounds, it is preferred in accordance with the invention to use those having a relatively low reactivity.

It has been found that the reaction rate constants (k) of a DIR-compound, determined by one of the known methods, can exhibit different values, depending on how the DIR-compound is dispersed. Thus, it is possible for the same DIR-compounds to be used both in the form of an aqueous-alkaline solution and also in the form of an emulsified product using a so-called coupler solvent or oil former. Hydrophobic DIR-compounds may be used in the form of aqueous dispersions, which may optionally be prepared using low-boiling organic solvents, or even in the form of the above-mentioned emulsified products. In the case of emulsified products, the rate constant may depend upon the type and quantity of solvent (oil former) used and upon the type of wetting agent used and the size of the droplets. For this reason, it is desirable to resort to the effective reaction rate constant ($k_{eff}$) of the DIR-compound in its particular dispersed form as a criterion for the suitability of the DIR-compound for use in accordance with the invention. Accordingly, it is best for determining the effective reaction rate to use the DIR-compound in the same dispersed form in which it is also intended to be used in the colour photographic material.

An electrochemical process has been developed for approximately determining in vitro the reactivity of dissolved or emulsified couplers in the form of an effective reaction rate constant ($k_{eff}$[1/mole·sec]). The effective rate constant is calculated from the consumption of developer oxidation product determined by measuring the redox potential in a "stopped flow" apparatus. The $k_{eff}$-values quoted in the present description were determined by the method described below.

The structure and mode of operation of the measuring apparatus used are described in the following with reference to FIGS. 1 and 2, of which:

Figure 1:
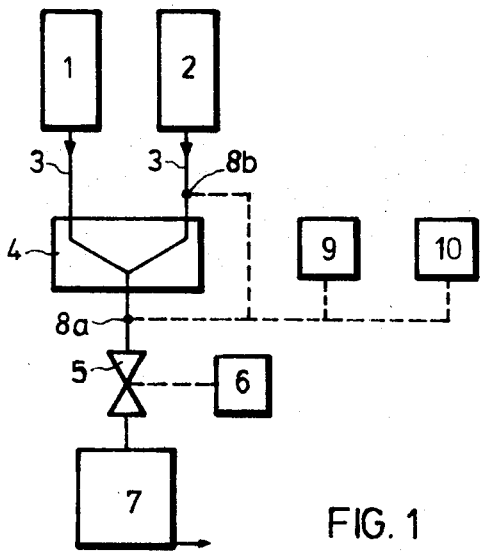
FIG. 1 is a block diagram of the measuring apparatus.

The measuring apparatus illustrated in FIG. 1 consists of cylindrical, approximately 25 cm tall storage vessels 1 and 2, feed pipes 3 equipped with non-return valves, a mixing chamber 4, a magnetic valve 5 which is closed in its rest position and which can be opened by means of a pulse generator 6, a collecting vessel 7 in which a reduced pressure is generated and maintained, a measuring electrode 8*a*, a reference electrode 8*b*, a digital mV-meter 9 and a recorder 10.

The magnetic valve 5 is opened for a time t by means of the pulse generator 6. Due to the pressure gradient between the collecting vessel 7 and the storage vessels 1 and 2, the liquids accommodated in the storage vessels 1 and 2 flow through the feed pipes 3 into the mixing chamber where intensive mixing occurs. The mixture then flows through the magnetic valve 5 into the collecting vessel 7. The storage vessel 1 contains an oxidising agent, for example a $0.5 \cdot 10^{-3}$ molar aqueous solution of $K_3[Fe(CN)_6]$. The storage vessel 2 contains a colour developer, the coupler to be investigated and means for adjusting a required pH-value (buffer), all in aqueous solution.

The content in the storage vessel 2 was made up as follows:

30 ml of the ready-to-use developer solution described in The British Journal of Photography, 12 July 1974, pages 597 and 598, were mixed with an aqueous solution or dispersion of $2 \cdot 10^{-3}$ moles of the coupler to be investigated. Couplers which are not soluble in water may be used in the form of a dispersion obtained in known manner from the coupler, a coupler solvent and a hydrophilic binder. The binder used in the experiment was gelatine. In each case gelatine was added so that the total amount of gelatine was 10 g. The mixture was filled up with water to yield 1000 ml and the pH was adjusted to 10.2 by using a carbonate/hydrogen/carbonate buffer. The temperature of measurement was 20° C. Minor modifications are admissable as regards the concentrations of the oxidizing agent, the developer, the coupler or the binder without seriously affecting the result of the measurement.

The redox potential of the mixture is measured with the measuring electrode 8*a* (1 mm diameter platinum wire). The reference electrode 8*b* is an Ag/AgCl-electrode (Argenthal cartridge) which, in this embodiment, is situated in the feed pipe from the storage vessel 2 to the mixing chamber, although it may also be mounted in the usual way adjacent the platinum electrode. The measured redox potential of the mixed solutions can be read off by means of the digitial mV-meter 9 and recorded as a function of time by means of the recorder 10 (compensation recorder, oscillograph or light-spot curve tracer).

Figure 2:
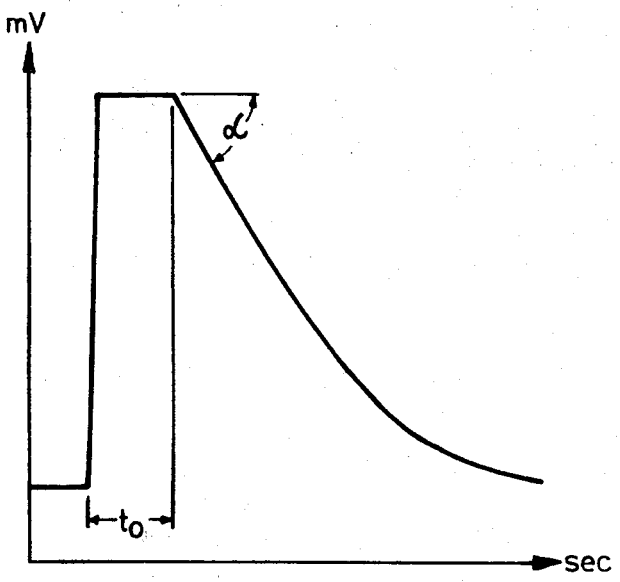
FIG. 2 is a graph obtained by this measuring apparatus for determining a $k_{eff}$-value.

The redox potential as a function of time is shown in FIG. 2. The measured redox potential in mV (ordinate)

is plotted against time in seconds (abscissa). $t_o$ represents the opening time of the magnetic valve. The effective reaction rate constant $k_{eff}$ may be calculated from the angle $\alpha$ in accordance with the following equation:

$$k_{eff} = \frac{1}{K_o \cdot f} (tg\alpha_K - tg\alpha_o)$$

in which $k_{eff}$=reaction rate constant [1/mole.sec.]
$K_o$=initial concentration of coupler [mole/1]
f=electrochemical constant (f=R·T/n·F)
$\alpha_K$=angle $\alpha$ obtained in the presence of coupler
$\alpha_o$=angle $\alpha$ obtained in the absence of coupler.

After the solutions have been introduced into the storage vessels 1 and 2, the mixing chamber 4 and the inlet and outlet pipes are vigourously rinsed by prolonged opening of the magnetic valve 5, after which the vessels are refilled to the original level. The potential-time curve shown in FIG. 2 can then be recorded by briefly opening the magnetic valve 5. The angle $\alpha$ (FIG. 2) between the time axis and the tangent to the measuring curve at the beginning of the reaction is determined once with the coupler to be investigated ($\alpha_K$) and once in the absence of coupler ($\alpha_o$). By introducing the two $\alpha$-values into the above equation, it is possible to determine the effective reaction rate constant $k_{eff}$.

The method may of course also be modified in many different ways. Thus, it is possible to use other colour developers and also to carry out the reaction at other pH-values. For measuring the reactivity of couplers which are oxidised very rapidly by ferricyanide, the apparatus may be modified to the extent that a system of two mixing chambers arranged one behind the other is used instead of the single mixing chamber 4, the developer oxidation product being produced in the first of these mixing chambers by mixing together developer and ferricyanide and then being mixed with the coupler to be measured in the second mixing chamber. The measuring electrode is primarily used for measuring the concentration of developer oxidation product which is presumably the quinone diimine of the corresponding colour developer used. For the principles of redox measurement, reference is made for example to J. EGGERS "Uber die Folgereaktionen bei der Oxydation von p-Amino-N-dialkylanilinen" in "Mitteilungen aus den Forschungslaboratorien der Agfa," Vol. III, Page 73 (1961).

DIR-couplers and DIR-compounds which, according to the invention, are preferably used in the intermediate layer between the two colour-forming component layers of the comparatively more sensitive emulsion layer unit preferably have $k_{eff}$-values of from 200 to 4000, more particularly from 500 to 2000 l/mole.sec. determined at 20° C. and a pH-value of 10.2. If the reactivity is less than 200 l/mole .sec., the coupler is not reactive enough to produce an adequate inter-image effect in the two adjacent layers. If the $k_{eff}$-value is higher than 4000, there is a danger of losses of sensitivity occuring in the adjacent layers. It is, of course, also possible to use more reactive DIR-compounds of this type in cases where a loss of sensitivity in the adjacent photosensitive component layers is acceptable. More reactive DIR-compounds such as these may be used, for example, in cases where sensitivity reserves are present or where additional measures are taken to compensate the losses of sensitivity attributable to the DIR-compounds.

The quantity of DIR-coupler or DIR-compound used in the intermediate layer amounts, for example, to between 0.5 and 5 mMole/m$^2$, depending upon the extent of the required inter-image effect. It is also possible to use several DIR-couplers with different $k_{eff}$-values, which preferably lie within the above-mentioned limits, in suitable mixing ratios.

It has proved to be a particular advantage that the intermediate layer according to the invention containing both a Mikrat emulsion and also a DIR-compound can be kept comparatively thin. An intermediate layer such as this is preferably between 0.3 and 1.5 $\mu$m thick. An excessive layer thickness would complicate diffusion of the inhibitor released from the DIR-compound, for example from those parts of the layer adjacent the highly sensitive cyan layer into the more sensitive green-sensitive layer. If the layer is too thin, there is no longer any guarantee of an adequate colour separation between the two more sensitive red-sensitive and green-sensitive layers.

It is remarkable that, by virtue of the structure according to the invention of the intermediate layer arranged between the more sensitive red-sensitive and the more sensitive green-sensitive component layer of the comparatively more sensitive emulsion layer unit, the thickness of this intermediate layer can be considerably reduced by comparison with a pure binder layer or an intermediate layer which contains in known manner a white coupler in a binder, such as gelatin, without at the same time having to accept a falsification of colour attributable to undesirable co-coupling. Thus, it has been found, for example, that the undesirable co-coupling can be effectively prevented by a 0.7$\mu$ thick intermediate layer according to the present invention, whereas a layer thickness of 2.4$\mu$ is required for this purpose where a pure binder layer is used. It is obvious that this has a favourable effect upon the sharpness of the colour photographic recording material according to the invention.

The sequence of the red-sensitive and the green-sensitive silver halide emulsion layers in the comparatively more sensitive emulsion layer unit is arbitrary. The red-sensitive silver halide emulsion layer may be situated either above or below the green-sensitive layer, although the latter arrangement is preferred. One or both of the highly sensitive layers may also be split up into two component layers which may then differ from one another, for example in their silver halide/colour coupler ratio and/or in the nature of the silver halide or the colour couplers which nevertheless give the same colour.

In the comparatively less sensitive emulsion layer unit, the arrangement of the two photosensitive layers of a different spectral sensitivity is also arbitrary, although in this case too the green-sensitive silver halide emulsion layer is preferably situated above the red-sensitive silver halide emulsion layer. The comparatively less sensitive emulsion layer unit may optionally contain, instead of a single red-sensitive and a single green-sensitive silver halide emulsion layer, two or even more of each of these layers which, in that case, advantageously differ in their general sensitivity and are arranged in such a way that layers having the same spectral sensitivity are more sensitive, the further away they are situated from the support. A plurality of layers such as this may be combined either into sub-units of substantially comparable general sensitivity or into sub-units having the same spectral sensitivity.

Instead of a single blue-sensitive silver halide emulsion layer, two or more blue-sensitive silver halide emulsion layers may also be present in known manner in the colour photographic recording material according to the invention for producing the yellow component colour image.

In addition to the already mentioned layers, other non-photosensitive auxiliary layers may be present in the colour photographic recording material according to the invention, for example adhesion layers, antihalation layers or cover layers, more particularly intermediate layers between the photosensitive layers, which are intended effectively to prevent developer oxidation products from diffusing from one layer into another layer. To this end, intermediate layers such as these may also contain certain compounds which are capable of reacting with developer oxidation products. Layers such as these are preferably arranged between adjacent photosensitive layers of different spectral sensitivity. As already mentioned, the colour photographic recording material according to the invention contains two photosensitive component layers of different sensitivity at least for producing each of the cyan and the magenta component colour images. The sensitivity in question here is not the absolute sensitivity, but instead the effective sensitivity taking into account the particular position within the colour photographic multilayer material. The difference in the effective sensitivity best amounts to between 0.2 and 1.0 relative log $I \times t$-units. In each individual case, the difference in sensitivity is selected in such a way that a compensated gradation curve without any noticeable distortion is obtained during colour photographic processing. Measures for obtaining a required sensitivity level are known and include, for example, changing the composition of the silver halide, the extent of physical ripening (grain size), the degree of chemical or spectral sensitisation or adding a desensitiser. In the interests of as high a total sensitivity as possible, the "less sensitive" component layer should of course also have as high a sensitivity as possible providing only the sensitivity relation required in accordance with the invention remains intact. The constituents of the more sensitive layer should best be measured in such a way that a lower colour density is obtained during colour development than in the less sensitive layer. This result may be achieved conventionally by reducing the amount of silver applied and/or by altering the coupler/silver ratio.

A colour coupler which is capable of reacting with colour developer oxidation products to form a non-diffusible dye is associated with each of the above-mentioned photosensitive silver halide emulsion layers (except for the additional chloride-containing silver halide emulsion layer of comparatively low sensitivity). However, the additional chloride-containing silver halide emulsion layer may optionally contain colour couplers as well. The colour couplers are preferably non-diffusible and are accommodated in the photosensitive layer itself or in the immediate vicinity thereof. The colour couplers associated with the two component layers having the same spectral sensitivity do not necessarily have to be identical. They are only required to give the same colour during colour development, normally a colour which is complementary to the colour of the light to which the photosensitive silver halide emulsion layers are sensitive. Accordingly, at least one non-diffusible colour coupler for producing the cyan component colour image, generally a coupler of the phenol or $\alpha$-naphthol type, is associated with each of the red-sensitive silver halide emulsion layers. The green-sensitive silver halide emulsion layers each contain at least one non-diffusible colour coupler for producing the magenta compnent colour image, normally a colour coupler of the 5-pyrazolone or indazolone type. Finally, the blue-sensitive silver halide emulsion layers contain a non-diffusible colour coupler for producing the yellow component colour image, generally a colour coupler containing an open-chain keto-methylene group. Colour couplers such as these are known in large numbers and are described in a number of Patent Specifications. Reference is made here, for example, to the publications "Farbkuppler" by W. Pelz in "Mitteilungen aus den Forschungslaboratorien der Agfa, Leverkusen/Munchen," Vol.III, Page 111, (1961), and K. Venkataraman in "The Chemistry of Synthetic Dyes," Vol. 4, 341 to 387, Academic Press, (1971).

The colour couplers may be both standard 4-equivalent couplers and also 2-equivalent couplers in which a smaller quantity of silver halide is required for colour production. 2-Equivalent couplers are derived in known manner from the 4-equivalent couplers in that they contain in the coupling site a substituent which is released during coupling. 2-Equivalent couplers which may be used in accordance with the invention include both those which are substantially colourless and also those which have an intensive natural colour which disappears during colour coupling or is replaced by the colour of the image dye produced. According to the invention, the latter couplers may also be additionally present in the photosensitive silver halide emulsion layers where, as masking couplers, they serve to compensate the undesirable secondary densities of the image dyes. The 2-equivalent couplers also include the known white couplers although these known white couplers do not form a dye on reaction with colour developer oxidation products and hence only participate indirectly in the structure of the colour image. The 2-equivalent colour couplers also include the known DIR-couplers which are couplers which contain in the coupling site a releasable radical which is released as a diffusible development inhibitor on reaction with colour developer oxidation products.

It is possible if required to use colour coupler mixtures in order to adjust a particular colour or to obtain a desired reactivity. For example, water-soluble couplers may be used in combination with hydrophobic water-insoluble couplers.

Whereas water-soluble couplers are generally added to the emulsion in the form of aqueous alkaline solutions, hydrophobic couplers are best incorporated by one of the known emulsification processes in which, for example, the coupler is dissolved in an organic solvent, optionally in the presence of a high-boiling coupler solvent, and then dispersed in a gelatin solution. Examples of high-boiling coupler solvents are dibutyl phthalate and tricresyl phosphate. Other coupler solvents are described, for example, in U.S. Pat. Nos. 2,322,027; 3,689,271; 3,764,336 and 3,765,897.

It is also possible to prepare aqueous dispersions of the hydrophobic couplers and to add them to the particular casting solutions. To this end, aqueous suspensions of the casting solutions. To this end, aqueous suspensions of the couplers are finely ground, for example, by intensive stirring with addition of sharp sand and/or by applying ultrasonic waves, in the absence of significant quantities of organic solvents. In this connection, reference is also made to German Offenlegungsschrift No. 2 609 741.

In addition, at least one silver halide emulsion layer in the comparatively less sensitive emulsion layer unit preferably contains a non-diffusible compound which is capable of liberating a diffusible development inhibitor on reaction with colour developer oxidation products. The non-diffusible compound in question may again be one of the already mentioned dye-forming DIR-couplers or, preferably, a colourlessly coupling DIR-compound.

Compounds which are capable of reacting with colour developer oxidation products and which therefore prevent an undesirable diffusion of the colour developer oxidation products may be present in the intermediate layers which are arranged between the photosensitive silver halide emulsion layers and of which the binder preferably consists of gelatin. Examples of compounds such as these are non-diffusible reducing agents, for example hydroquinone derivatives, or couplers which do not form any dye remaining in the layers on reaction with the colour developer oxidation products. The already mentioned white couplers are particularly suitable for this purpose, although it is also possible to use colour couplers which form a soluble dye which is washed out of the layers during colour photographic processing. Other suitable compounds for suppressing the undesirable diffusion of colour developer oxidation products are described, for example, in the book "Stabilisation of Photographic Silver Halide Emulsions" by E. J. Birr, The Focal Press, 1st Edition, 1974, pages 116 to 122.

For other suitable additives for the colour photographic recording materials according to the invention or for one of their layers, reference is made to the Article in the Journal "Product Licensing Index," Vol. 92, December 1971, pages 107 to 110.

Colour developers suitable for the colour photographic processing of the material according to the invention are the usual colour developers, particularly those of the p-phenylene diamine series, for example 4-amino-N,N-dimethyl aniline, 4-amino-N,N-diethyl aniline, 4-amino-3-methyl-N,N-diethyl aniline, 4-amino-3-methyl-N-methyl-N-(β-methylsulphonamidoethyl)-aniline, 4-amino-N-ethyl-N-(β-hydroxyethyl)-aniline, 4-amino-3-methyl-N-ethyl-N-(β-hydroxyethyl)-aniline, 4-amino-3-methyl-N-ethyl-N-(β-methoxyethyl)-aniline, 4-amino-3-methyl-N-ethyl-N-(β-methylsulphonamidoethyl)-aniline, 4-amino-N-butyl-N-(ω-sulphobutyl)-aniline and 4-amino-3-methyl-N-isopropyl-N-(ω-sulphobutyl)-aniline.

Other suitable colour developers are described, for example, in J. Amer. Chem. Soc., 73, 3100–3125 (1951).

EXAMPLES

In order to illustrate the invention, several colour photographic recording materials are compared with one another in the following, starting out from the layer structure described below. To this end, the above-mentioned layers are applied in the order indicated to a transparent layer support. The quantities quoted are based in each case on 1 square meter. The corresponding quantities of $AgNO_3$ are quoted for the silver coating weight.

1. A less sensitive red-sensitive layer containing a red-sensitised silver bromide-iodide emulsion (5 mole % of AgI) of 3.0 g of $AgNO_3$ with 790 mg of a cyan coupler corresponding to the formula

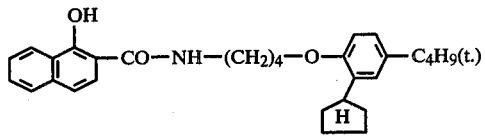

25 mg of a DIR-coupler corresponding to the formula

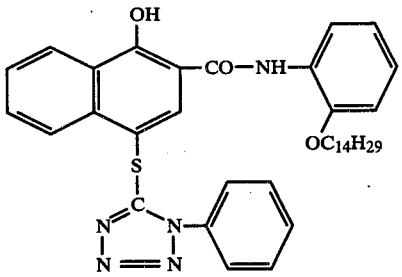

and 1.6 g of gelatin.

2. An intermediate layer of 0.7 g of gelatin.
3. A less sensitive green-sensitive layer containing a green-sensitised mixture of a relatively sensitive silver bromide-iodide emulsion (5 mole % of AgI) of 1.5 g of $AgNO_3$ and a relatively low sensitive silver bromide-iodide emulsion of 1.9 g of $AgNO_3$ with 600 mg of a magenta coupler corresponding to the formula

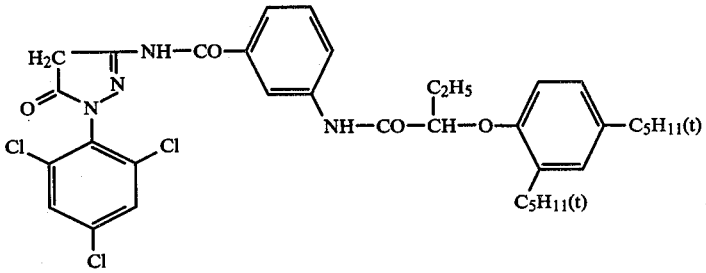

60 mg of a DIR-coupler corresponding to the formula

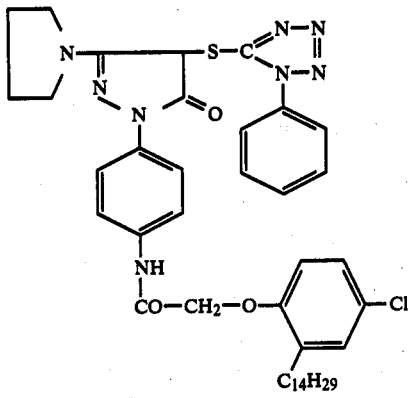

80 mg of a masking coupler corresponding to the formula

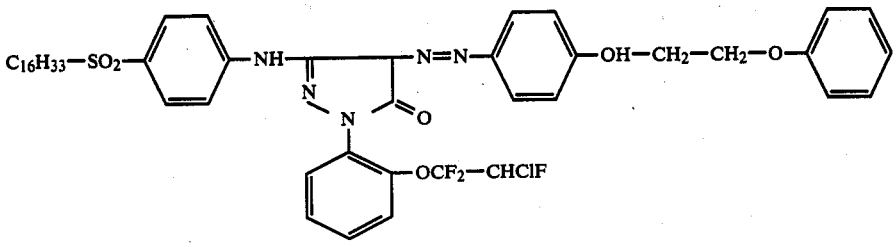

and 2.0 g of gelatin.

4. An intermediate layer containing 0.7 g of gelatin.
5. A highly sensitive red-sensitive layer containing a red-sensitised silver bromide-iodide emulsion (5 mole % of AgI) of 2.0 g of $AgNO_3$ with 250 mg of the cyan coupler of layer 1 and 1.0 g of gelatin.
6. An intermediate layer as defined below.
7. A highly sensitive green-sensitive layer containing a green-sensitised silver bromide iodide emulsion (7 mole % of AgI) of 2.8 of $AgNO_3$ with 170 mg of a magenta coupler corresponding to the formula

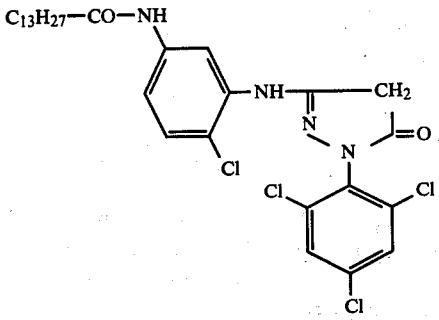

37 mg of magenta coupler corresponding to the formula

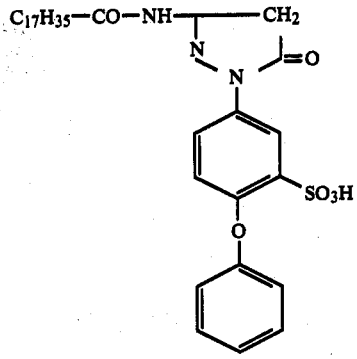

and 2.1 g of gelatin.

8. An intermediate layer containing 0.7 g of gelatin.
9. A yellow filter layer containing colloidal silver for producing a yellow density of 0.8.
10. A blue-sensitive layer containing a mixture of a sensitive silver bromide-iodide emulsion (9 mole % of AgI) of 1.0 g of $AgNO_3$ and a non-sensitive silver bromide-iodide emulsion (3 mole % of AgI) of 0.6 of $AgNO_3$ with 1.0 g of a yellow coupler corresponding to the formula

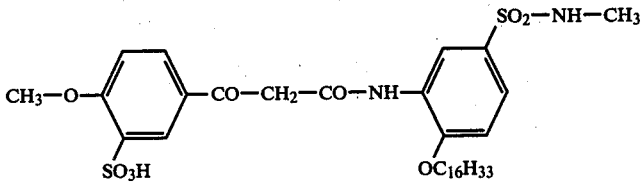

and 2.0 g of gelatin.

11. A cover layer of 0.7 g of gelatin.

The composition and quality of the intermedite layer 6 was varied in the recording materials to be compared with one another, as indicated in Table 1 below:

Table 1:

| Example | 1 | 2 | 3 | 4 | 5 | 6 |
|---|---|---|---|---|---|---|
| Layer thickness [μ] | 2.4 | 0.7 | 0.7 | 0.7 | 2.4 | 0.7 |
| Mikrat emulsion [g of $AgNO_3/m^2$] | 0.51 | 0.17 | 0.08 | 0.34 | 0.51 | 0.17 |
| DIR-compound A [mMole/$m^2$] | — | 0.14 | 0.14 | 0.14 | 0.42 | — |
| DIR-compound B [mMole/$m^2$] | — | — | — | — | — | 0.03 |
| White coupler [mMole/$m^2$] | 0.18 | — | — | — | — | — |

The Mikrat emulsion used was a very fine grained silver chloride emulsion (average grain size <0.1μ).

DIR-compound A:

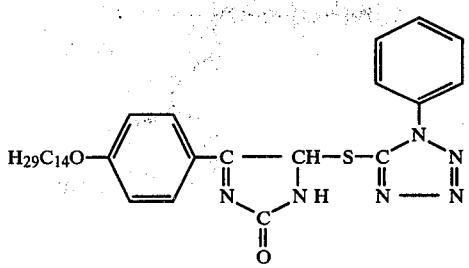

DIR-compound A is emulsified in accordance with the following recipe:

A solution of 10 g of DIR-compound A in 10 g of dibutyl phthalate, 30 ml of ethyl acetate and 5 g of dimethyl formamide is emulsified with intensive mixing in a mixing siren into a solution of 100 ml of a 5% aqueous gelatin solution and 0.8 g of Mersolat (Trade Mark), (wetting agent, sulphonated paraffin hydrocarbons). The ethyl acetate is then evaporated off.

$k_{eff}$: 700 [1/mole. sec.] (measured as emulsified product).

DIR-compound B

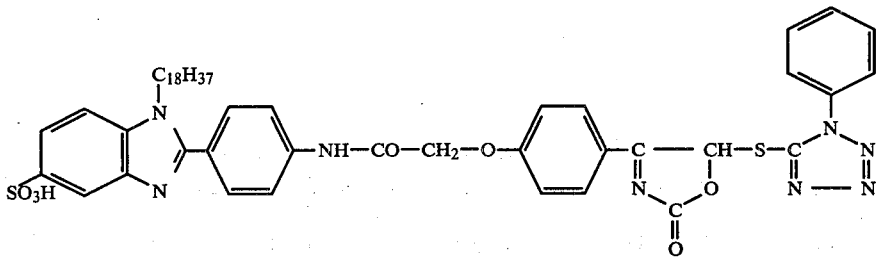

DIR-compound B is dissolved in accordance with the following recipe:

10 g of DIR-compound B are made into a paste with 40 ml of methanol and a pH-value of 10 is adjusted by adding 0.1 N NaOH at 50° C. After stirring until complete dissolution has been obtained, the pH-value is adjusted to 6.5 by adding 0.01 N $H_2SO_4$.

$k_{eff}$: 40,000 [1/mole.sec.] (measured as a solution).

White coupler:

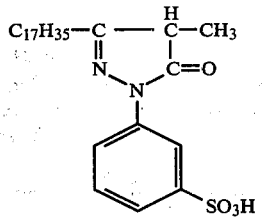

The white coupler is dissolved in the same way as the DIR-coupler B.

After exposure behind green or red filters, respectively, the materials were processed as described in The British Journal of Photography, July 1974, pages 597 and 598.

The cyan- and magenta-($\gamma_1$)-inter-image effects obtained, i.e. the inter-image effects (IIE) in the low colour density regions of the cyan and magenta component colour images, and the sensitivity of the cyan and magenta component colour images are shown in Table 2 below.

The inter-image effects are defined as follows:

$$IIE = \frac{\gamma s - \gamma w}{\gamma w} \cdot 100\%$$

s: selective exposure (green or red)

w: white exposure $\gamma_1$ is the gradation section of the characteristic curve which extends from the photosensitivity point (D=0.2 over fog)

to an exposure value which is higher by 0.8 log I.t-units. The section extending from this end point to an exposure value which is higher by another 0.8 log.I.t-units is designated $\gamma_2$, etc.

The sensitivity is expressed in rel.log.I.t-units, on the one hand as "inertia speed," i.e. the relative log.I.t-value which is obtained as the point of intersection on extrapolation of the linear part of the characteristic curve with the fog density, and on the other hand the relative log.I.t-value for a density of 0.2 over the fog.

Table 2

| | IIE | | Sensitivity | | | |
|---|---|---|---|---|---|---|
| | pp($\gamma_1$) | bg($\gamma_1$) | inertia speed | | at 0.2 over fog | |
| Example | % | % | pp | bg | magenta | cyan |
| 1 | 0 | 4 | 4.40 | 4.39 | 4.12 | 4.10 |
| 2 | 23 | 21 | 4.40 | 4.38 | 4.09 | 4.00 |
| 3 | 18 | 24 | 4.33 | 4.34 | 4.05 | 3.95 |
| 4 | 23 | 22 | 4.48 | 4.50 | 4.19 | 4.09 |
| 5 | 10 | 13 | 4.31 | 4.34 | 4.07 | 4.0 |
| 6 | 20 | 25 | 4.29 | 4.27 | 3.95 | 3.83 |

The results set out in the Table show the following:

By incorporating DIR-compounds in the Mikrat-containing intermediate layer 6, both the cyan and also the magenta inter-image effects are increased in the $\gamma_1$-range (Examples 1 and 2).

A DIR-compound of relatively low coupling reactivity is advantageous because, in this case, the cyan and magenta sensitivity are only negligibly reduced (Examples 1 and 2).

A DIR-compound of relatively high coupling reactivity produces greater reductions in the magenta and cyan sensitivities for similar gradation (Examples 2 and 6).

Relatively narrow layer thicknesses of the intermediate layer are favourable to the inter-image effects (Examples 2 and 5).

Even when DIR-compounds are present in the intermediate layer, sensitivity can be controlled to a certain extent through the quantity of Mikrat emulsion without the inter-image effects being influenced to any significant extent (Examples 2, 3 and 4).

In the absence of DIR-compound, a layer thickness of 2.4$\mu$ is necessary for preventing co-coupling. The same effect is obtained with DIR-compounds for layer thicknesses of only 0.7μ.

We claim:

1. A color photographic recording material comprising (a) a layer support, and applied thereon (b) several differently sensitized silver halide emulsion layers containing non-diffusible color couplers of which emulsion layers at least two are sensitive to red light and have different sensitivities and of which at least another two are sensitive to green light and have different sensitivities, the more sensitive of the two red-sensitive and the more sensitive of the two green-sensitive silver halide emulsion layers forming a comparatively more sensitive emulsion layer unit which is arranged further away from the layer support than each of the less sensitive red-sensitive and the less sensitive green-sensitive silver halide emulsion layers, and of which emulsion layers at least one is sensitive to blue light and is arranged further away from the layer support than each of the red-sensitive and the green-sensitive silver halide emulsion layers, and (c) at least one yellow filter layer which is arranged further away from the layer support than each of the red-sensitive and the green-sensitive silver halide emulsion layers and, optionally, (d) other non-photosensitive layers, wherein the improvement comprises an additional silver halide emulsion layer of comparatively low sensitivity, in which the silver halide contains from 20 to 100 mol % of silver chloride, the balance being silver bromide and the silver halide particles have an average grain diameter of less than 0.5 μm, and which contains a non-diffusible compound capable of reacting with color developer oxidation products to release a diffusible silver halide development inhibitor, said compound having at 20° C. and at pH 10.2 an effective reaction rate constant in the coupling reaction with 2-methyl-N-ethyl-N-β-hydroxyethyl-p-phenylene diamine of between 200 and 4000 [1. $mole^{-1} \cdot sec^{-1}$], is arranged within the comparatively more sensitive emulsion layer unit between the red-sensitive and the green-sensitive silver halide emulsion layer.

2. The recording material of claim 1 wherein in the additional silver halide emulsion layer the silver halide particles have an average grain diameter of less than 0.1 μm.

3. The recording material of claim 1 wherein in the additional silver halide emulsion layer the non-diffusible compound is capable of reacting with color developer oxidation products without at the same time giving rise to substantial formation of any permanent dyes.

* * * * *